US005902179A

United States Patent [19]

Yeh

[11] Patent Number: 5,902,179

[45] Date of Patent: May 11, 1999

[54] COIN RELEASING DEVICE OF A COIN STACKING MACHINE

[75] Inventor: Henry Yeh, Taipei Hsien, Taiwan

[73] Assignee: Entropy International Co., Ltd., Taipei Hsien, Taiwan

[21] Appl. No.: 08/986,757

[22] Filed: Dec. 8, 1997

[51] Int. Cl.[6] ..... G07D 1/00; B65H 31/30; B65B 35/50

[52] U.S. Cl. ..... 453/18; 414/790.3; 53/532

[58] Field of Search ..... 453/18, 31, 61; 414/789, 790.3; 53/532, 212, 540

[56] References Cited

U.S. PATENT DOCUMENTS

| | | | |
|---|---|---|---|
| 3,005,560 | 12/1957 | Lopez | 414/790.3 |
| 3,382,647 | 5/1968 | Davey et al. | 53/532 |
| 3,686,820 | 8/1972 | Zenger et al. | 53/532 |

*Primary Examiner*—F. J. Bartuska
*Assistant Examiner*—Bryan Jaketic
*Attorney, Agent, or Firm*—Dougherty & Troxell

[57] ABSTRACT

A coin releasing device of a coin stacking machine, including a rotary mechanism and a transmission mechanism locked therewith. The rotary mechanism is rotated to drive a transmission plate of the transmission mechanism, whereby the pushing plates on two sides of the transmission plate can stack and push out the coins.

4 Claims, 4 Drawing Sheets

COIN RELEASING DEVICE OF A COIN STACKING MACHINE

BACKGROUND OF THE INVENTION

The present invention relates to a coin releasing device of a coin stacking machine, which has a stacking cylinder structure for stacking and releasing coins. The coin releasing device is applicable to game machines.

Generally, the shooting games can be divided into two types. One type employs balloons as targets which are shot broken by B.B. bullet of an air gun. The other type employs light beam instead of the bullet to shoot the target.

The above shooting games can only provide monotonous shooting or video/audio effect and the player can get a prize only according to the number of the shot balloons. Therefore, the user cannot directly win a prize (such as coins) during the shooting.

SUMMARY OF THE INVENTION

It is a primary object of the present invention to provide a coin releasing device of a coin stacking machine, which releases stacked coins as prize during shooting game so as to increase the entertaining effect.

According to the above object, the coin releasing device of the Present invention includes a rotary mechanism and a transmission mechanism locked therewith. The transmission mechanism includes an irregular base board formed with shaft hole. A through hole of a slide block is overlaid on the shaft hole of the base board. Two sides of the slide block are fixed by locating blocks. An arch pushing Plate is secured at front end of the slide block. Two sides of the arch pushing plate are disposed with arch resilient plates. A rear side of the resilient plate is disposed with a projecting arm. A spring is hooked between the projecting arm and the base board. The base board is secured on a U-shaped frame of the rotary mechanism. The transmission plate is locked on the rotary shaft of the rotary mechanism by a nut. When the rotary mechanism is rotated, the transmission plate is rotated about the rotary shaft to make the slide block and the arch pushing plate move back and forth.

The present invention can be best understood through the following description and accompanying drawings, wherein:

DETAILED DESCRIPTION OF THE PREFERRED EMBODIMENT

Figure 1:
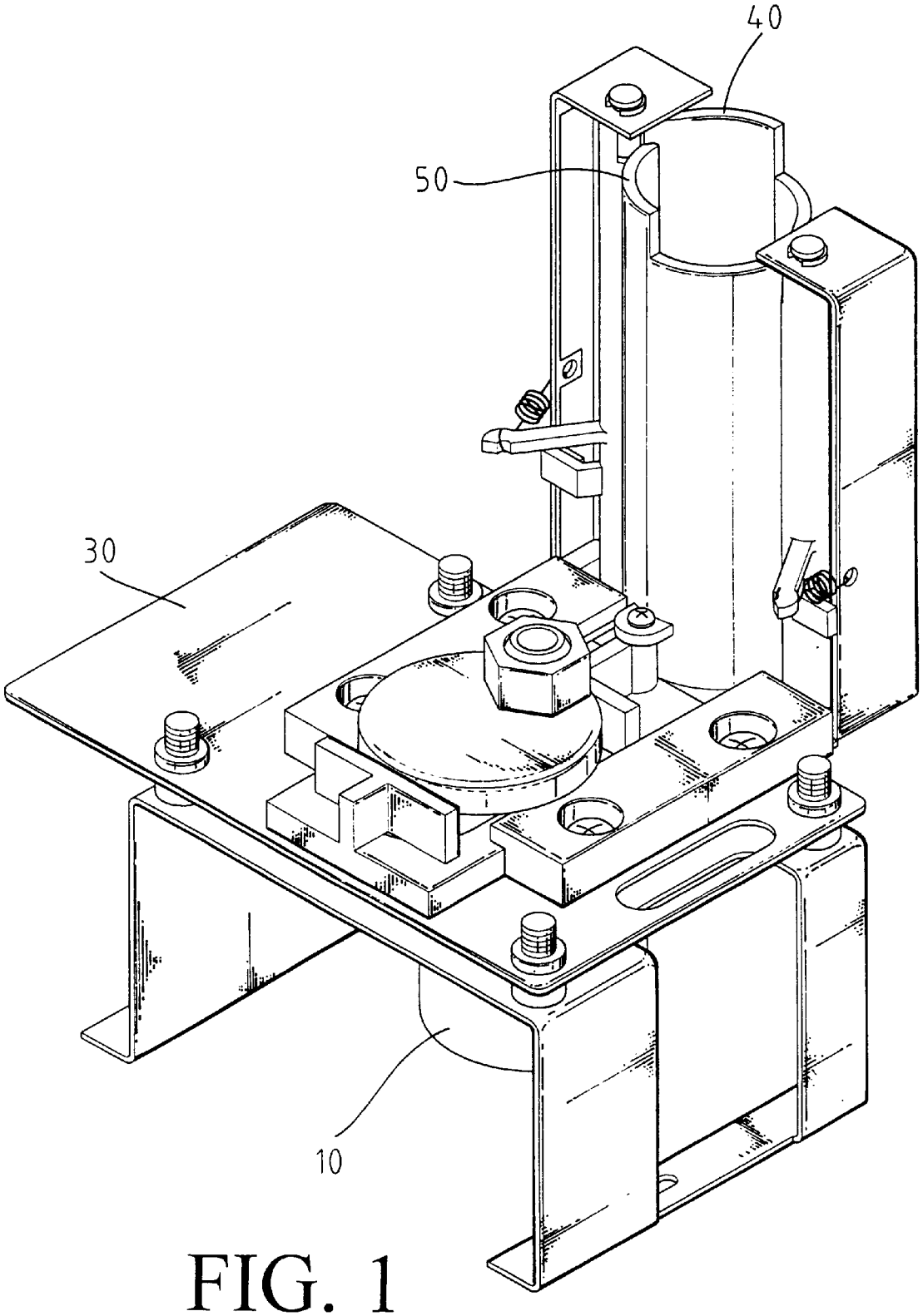
FIG. 1 is a perspective assembled view of the present invention.
Figure 2:
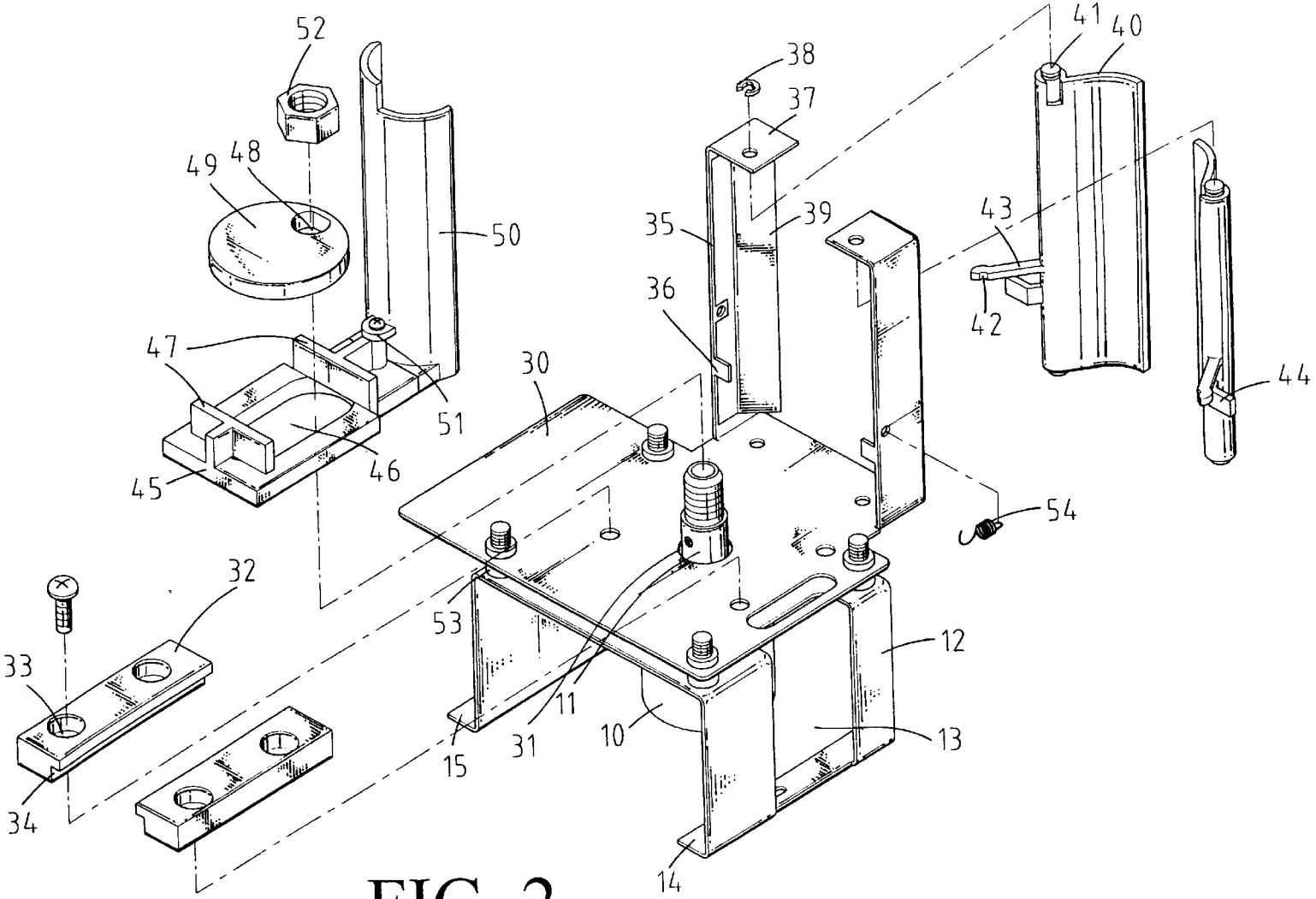
FIG. 2 is a perspective disassembled view of the present invention.

Please refer to FIGS. 1 and 2. The coin releasing device of the coin stacking machine of the present invention includes a rotary mechanism and a transmission mechanism locked therewith.

The rotary mechanism includes a U-shaped frame 12 and a motor 10 connected therewith. The bottom ends of two lateral walls of the U-shaped frame 12 are bent to the same side, each defining a bent section 14, 15. One of the lateral walls is formed with a central opening 13 extending from bottom end up to inner side of plane end edge of the U-shaped frame 12. The plane face of the U-shaped frame 12 near the opening 13 is disposed with a central through hole and several thread holes for locking the motor 10 and for the motor shaft 11 to pass therethrough. The motor shaft 11 is formed with outer thread. Each of four corners of the plane face of the U-shaped frame 12 is formed with thread holes.

The transmission mechanism is composed of a base board 30, two locating blocks 32, a slide block 45, a resilient plate 40 and a pushing plate 50. The base board 30 is an irregular plate body. A lower half of the base board 30 is rectangularly shaped and formed with a central through hole 31. Two sides of the lower half are formed with thread holes around the through hole 31 for locking two locating blocks 32 formed with thread holes 33. Each locating block 32 is formed with a slide channel 34 on one side of the bottom end. Multiple thread holes are disposed and spaced from the thread hole for locking the locating block 32 by a certain distance. Near the end edge is disposed a slot. A T-shaped plate body 35 projects from the edge of upper side of the rectangular plate body between the outermost thread holes. Two sides of the T-shaped plate body 35 are upward bent to form a U-shaped frame. The end section of the U-shaped frame is further inward bent to form a bent section 37.The two bent sections 37 and the base board 30 are formed with corresponding shaft holes in cooperation with C-shaped latch ring 38.

The inner side of the U-shaped frame is disposed with a stopper plate 39 with an angle. The rear side of the U-shaped frame near the bottom end is transversely disposed with a projecting plate 36 parallel to the base board 30. The upper end of the projecting plate 36 is disposed with an orifice.

The arch resilient plate 40 is disposed in accordance with the length of the U-shaped frame. The rear side of the resilient plate 40 encloses a rotary shaft 41 slightly longer than the resilient plate 40. Near the lower end of the resilient plate 40 is disposed a projecting arm 43. The end of the projecting arm 43 is disposed with a semiarch recess 42. A stopper plate 44 having a bent section is disposed under the projecting arm 43.

The center of the slide block 45 is formed with an elliptic slot 46. The front and rear ends of the slot 46 are disposed with projecting T-shaped stopper plates 47 having a width less than the slide block 45. Adjacent to the end of the front stopper plate 47 is formed thread hole for locking the arch pushing plate 50 having a locking ring 51.

Please refer to FIGS. 1 and 2. When assembled, the motor shaft 11 is first passed through the central through hole of the U-shaped frame 12. Then the motor 10 is locked on the U-shaped frame 12. The arch pushing plate 50 with the locking ring 51 is locked on the slide block 45 and then together therewith placed on the base board 30 with the through hole 46 of the slide block 45 overlaid on the through hole 31 of the base board 30. The arch pushing plate 50 is also placed between the U-shaped frame. Also, the slide channels 34 of the locating block 32 are engaged with two sides of the slide block 45 and secured on the base board 30 by screws. The rotary shaft 41 of the resilient plate 40 is passed through the shaft hole of the bent section 37 of the U-shaped frame. The recess 42 of the end of the projecting arm 43 of the resilient plate 40 is hooked with one end of the spring 54. The other end of the spring 54 is hooked with the orifice of the U-shaped frame . At this time, the stopper plates 39 of the resilient plate 40 are overlaid on the stopper plates 44 of the U-shaped frame. The motor shaft 11 is then passed through the base board 30 in the through hole 46 of the slide block 45 and then locked with the slide block 45. A fitting ring 53 is fitted around the screw, which locks the base board 30 and the U-shaped frame 12 so as to space the base board from the U-shaped frame. Then a transmission plate 49 with a shaft hole 48 at one end is fitted on the motor shaft 11 and tightened by a nut 52 to complete the assembly.

Figure 3:
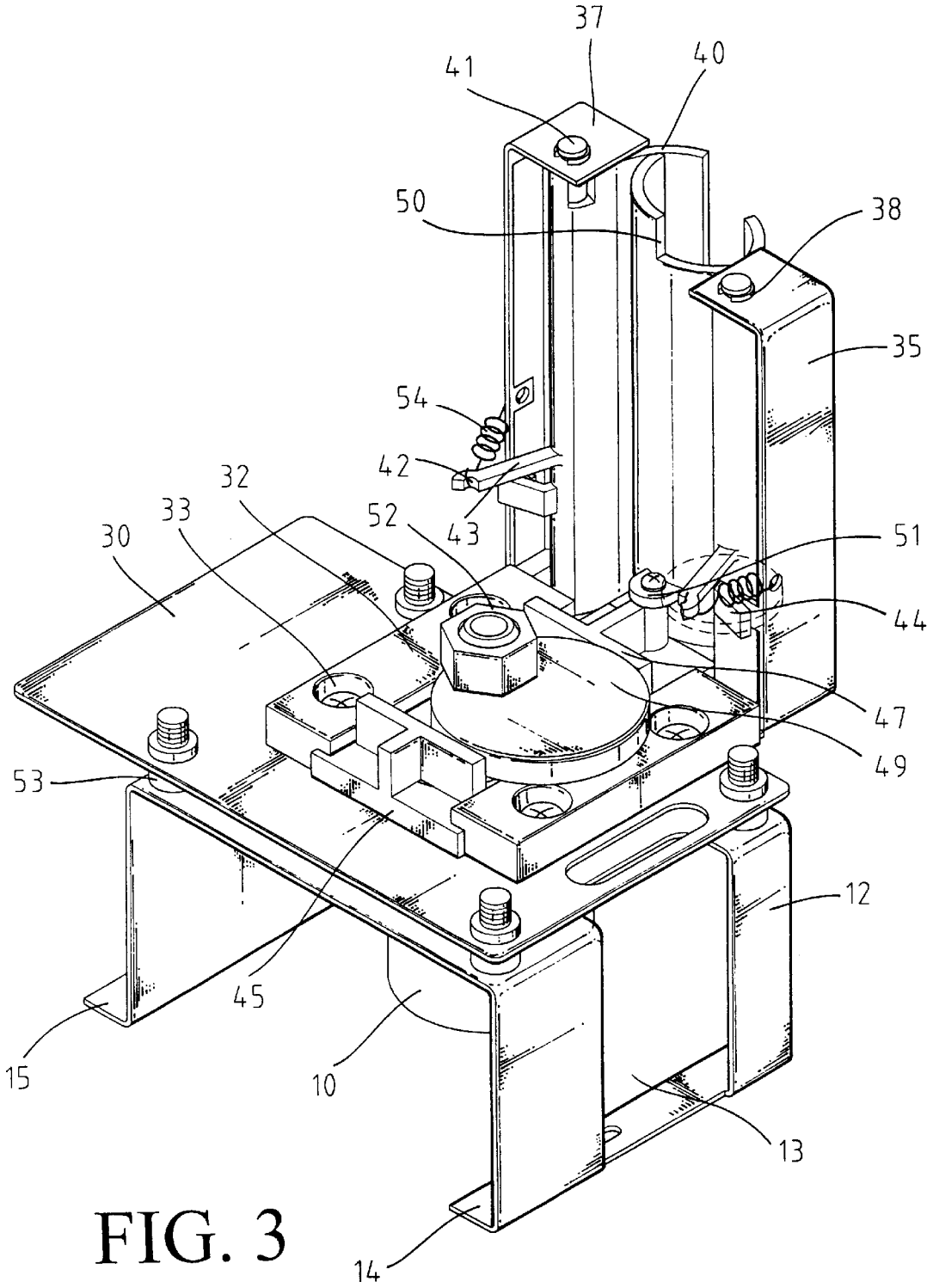
FIG. 3 shows the operation of the present invention in one state.
Figure 4:
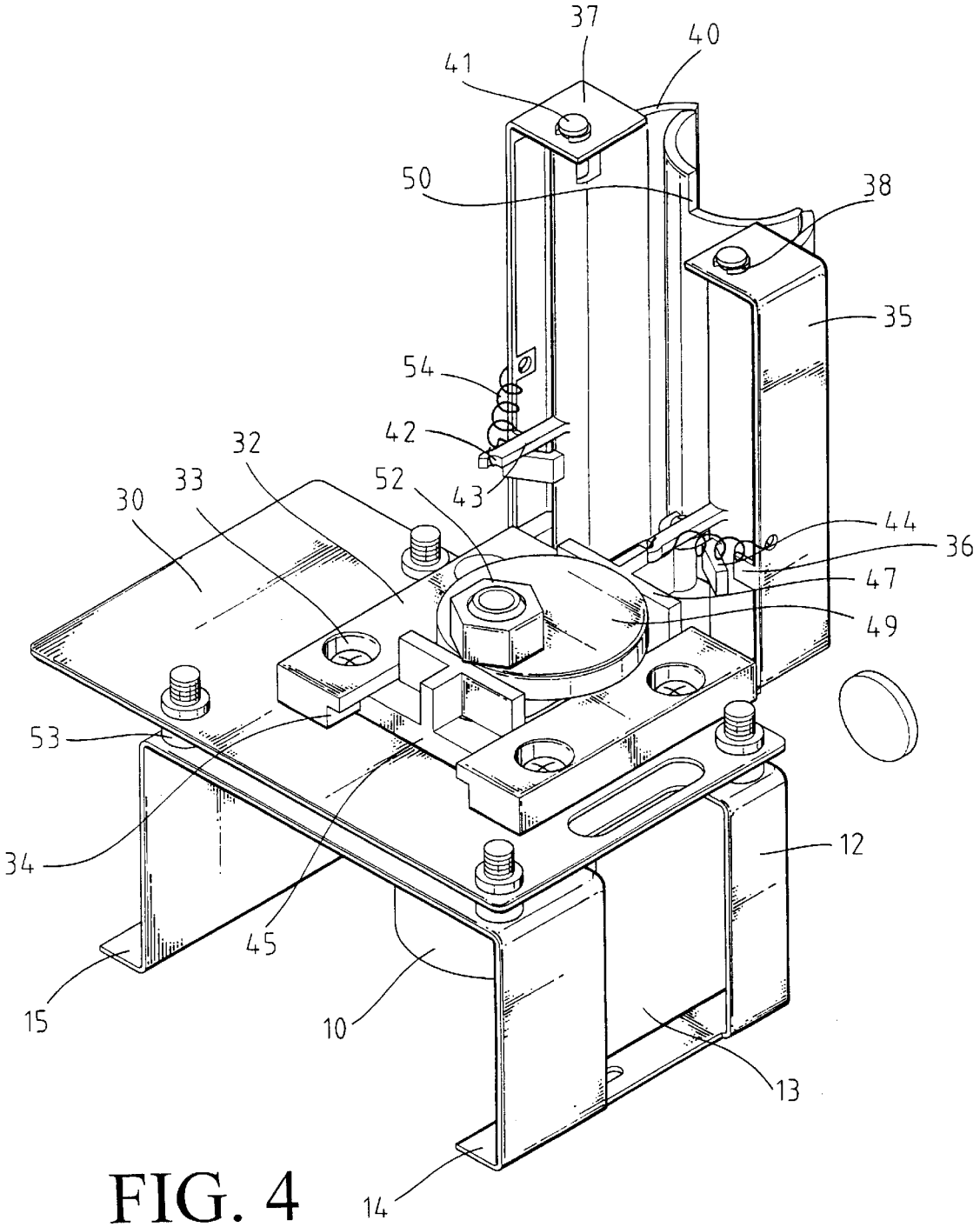
FIG. 4 shows the operation of the present invention in another state.

As shown in FIG. 1, in normal state, the slide block 45 is slided to rear side, making the two arch resilient plates 40 and the arch pushing plate 50 form a stacking cylinder. In the case of bingo, coins are counted by a counter and dropped and stacked in the stacking cylinder. When the coins drop into the stacking cylinder, the motor 10 is activated and the motor shaft 11 is driven. At this time, the transmission plate 49 is rotated about the motor shaft 11. When the transmission plate 49 rotates through ¼ circle, the slide block 45 is moved forward along with the transmission plate 49 (as shown in FIG. 3 ) and the arch pushing plate 50 is also moved forward to slightly stretch open the two arch resilient plates 40. Further, as shown in FIG. 4, when the transmission plate 49 is rotated through ½ circle, the arch pushing plate 50 and the resilient plates 40 are pushed to the end to make the coins slide down to stack the coins. When the transmission plate 49 is continuously rotated, the slide block 45 is moved back and the resilient plates 40 are restored to home position by the resilient force of the spring 54.

The present invention is widely applicable to game machines to tidily stack coins and release the same.

It should be noted that the above description and accompanying drawings are only used to illustrate one embodiment of the present invention, not intended to limit the scope thereof. Any modification of the embodiment should fall within the scope of the present invention.

What is claimed is:

1. A coin releasing device of a coin stacking machine, comprising a rotary mechanism and a transmission mechanism locked therewith, the transmission mechanism including an irregular base board formed with a shaft hole, a through hole of a slide block being overlaid on the shaft hole of the base board, two sides of the slide block being fixed by locating blocks, an arch pushing plate being secured at the front end of the slide block, two sides of the arch pushing plate being disposed with arch resilient plates, a rear side of the resilient plate being disposed with a projecting arm, a spring being hooked between the projecting arm and the base board, the base board being secured on a U-shaped frame of the rotary mechanism, a rotary shaft and a transmission plate being locked on the rotary shaft of the rotary mechanism by a nut, said coin releasing device being characterized in that:

the arch pushing plate and the two arch resilient plates together form a stacking cylinder, whereby when the rotary mechanism is rotated, the transmission plate is rotated about the rotary shaft to make the slide block and the arch pushing plate move back and forth.

2. A coin releasing device as claimed in claim 1, wherein the base board includes a lower half and an upper half, the lower half being a rectangular plate body, the upper half being a T-shaped plate body, a part of the T-shaped plate body being bent upward to form a U-shaped frame, whereby the upper half is perpendicular to the lower half.

3. A coin releasing device as claimed in claim 1, wherein the rotary mechanism includes a motor.

4. A coin releasing device as claimed in claim 1, wherein the shaft hole is disposed on the edge of the transmission plate.

* * * * *